US010982924B1

(12) United States Patent
Al Hazmi

(10) Patent No.: US 10,982,924 B1
(45) Date of Patent: Apr. 20, 2021

(54) WEAPON MOUNT

(71) Applicant: SAUDI ADVANCED TECHNOLOGIES COMPANY (WAHAJ), Riyadh (SA)

(72) Inventor: Ayman Bin Ahmed Al Hazmi, Riyadh (SA)

(73) Assignee: SAUDI ADVANCED TECHNOLOGIES COMPANY (WAHAJ), Riyadh (SA)

( * ) Notice: Subject to any disclaimer, the term of this patent is extended or adjusted under 35 U.S.C. 154(b) by 0 days.

(21) Appl. No.: 17/074,609

(22) Filed: Oct. 19, 2020

(51) Int. Cl.
*F41A 25/00* (2006.01)
*F41A 25/12* (2006.01)
*F41A 9/34* (2006.01)

(52) U.S. Cl.
CPC ..... *F41A 25/12* (2013.01); *F41A 9/34* (2013.01); *F41A 25/00* (2013.01)

(58) Field of Classification Search
CPC ..... F41A 25/00; F41A 25/02; F41A 25/04; F41A 25/06; F41A 25/10; F41A 25/12; F41A 25/14; F41A 25/16; F41A 25/18; F41A 25/20; F41A 25/22
See application file for complete search history.

(56) References Cited

U.S. PATENT DOCUMENTS 1,735,164 A * 11/1929 Green ..... F41A 25/14 89/44.01
1,757,244 A * 5/1930 Green ..... F41A 25/12 89/44.01
2,261,526 A * 11/1941 Salisbury ..... F41A 19/10 89/37.03
2,273,878 A 2/1942 Magrum et al.
2,309,807 A * 2/1943 Trotter ..... F41A 25/18 89/42.01
RE22,361 E 8/1943 Salisbury
(Continued)

FOREIGN PATENT DOCUMENTS

ES 2565694 A1 * 4/2016
WO WO-8911075 A1 * 11/1989 ..... F41A 25/10
WO WO-2015033188 A1 * 3/2015 ..... F41A 23/04

OTHER PUBLICATIONS

"LM76 Minuteman Linear Bearings" (2016), published at www.lm76.com\gun_mount.htm.

*Primary Examiner* — Gabriel J. Klein
(74) *Attorney, Agent, or Firm* — Nath, Goldberg & Meyer; Richard C. Litman

(57) ABSTRACT

The weapon mount is versatile, lightweight, easy to use, can absorb forces generated by recoil, and may be used for different types of weapons. The weapon mount includes a cradle mounted on a swing or swivel bracket, the cradle having a fixed front support and a back sliding support. First and second shock absorbers are mounted laterally in the cradle parallel to each other. A plurality of connection pins allow adjustment of the cradle to support different weapons. Ammo can holder brackets may be mounted on one side of the cradle. The shock absorbers have hinges, allowing the shock absorbers to be rotated to support different weapons. The swing bracket permits the weapon mount to be rotated 360° clockwise or counterclockwise, and the mount may be elevated 60° or lowered 10°. The weapon mount may be made of stainless steel.

12 Claims, 6 Drawing Sheets

(56) References Cited

U.S. PATENT DOCUMENTS

| | | | | |
|---|---|---|---|---|
| 2,339,226 | A * | 1/1944 | Trotter | F41A 25/14 89/42.01 |
| 2,376,835 | A * | 5/1945 | Trotter | F41A 9/54 89/33.14 |
| 2,393,257 | A * | 1/1946 | Greenhow, Jr. | F41A 25/10 89/37.03 |
| 2,439,105 | A * | 4/1948 | Sanford | F41A 25/10 89/44.01 |
| 2,644,366 | A | 7/1953 | Danielsen et al. | |
| 2,701,963 | A * | 2/1955 | Balleisen | F41A 25/10 73/167 |
| 2,731,829 | A | 1/1956 | Wigington et al. | |
| 5,159,148 | A | 10/1992 | Vinghog | |
| 6,286,411 | B1 * | 9/2001 | Sanderson | B64D 7/02 89/37.03 |
| 8,333,141 | B2 | 12/2012 | Schoning-Olsen et al. | |
| 9,021,728 | B1 | 5/2015 | Kocmich, IV et al. | |
| 9,062,927 | B1 * | 6/2015 | Tepaske | F41A 25/18 |
| 9,739,561 | B1 * | 8/2017 | Hagedorn | F41A 27/06 |
| 2006/0048642 | A1 * | 3/2006 | Beckmann | F41A 27/12 89/37.03 |
| 2016/0216056 | A1 | 7/2016 | Hagedorn et al. | |

* cited by examiner

WEAPON MOUNT

BACKGROUND

1. Field

The disclosure of the present patent application relates to weaponry, and particularly to a weapon mount for mounting a firearm, such as a machine gun.

2. Description of the Related Art

Some firearms, such as pistols, rifles, and shotguns, are designed to be used while portable and can be used quite effectively without a support. Other firearms, however, such as machine guns and grenade launchers, benefit from the use of a stand, tripod, pintle, or other supporting structure, which provides stability for better aim and helps to absorb recoil when firing the weapon. The firearm is usually attached to the support by a weapon mount or gun mount, such as the MK93 gun mount, which is used to support M2 series .50 caliber machine guns and MK19 40 mm grenade launchers, and can also support 7.62 mm machine guns with the use of adapters. While such gun mounts are effective, improvements are possible for more economical manufacture, assembly, and performance.

Thus, a weapon mount solving the aforementioned problems is desired.

SUMMARY

The weapon mount is versatile, lightweight, easy to use, can absorb forces generated by recoil, and may be used for different types of weapons. The weapon mount includes a cradle mounted on a swing or swivel bracket, the cradle having a fixed front support and a back sliding support. First and second shock absorbers are mounted laterally in the cradle parallel to each other. A plurality of connection pins allow adjustment of the cradle to support different weapons. Ammo can holder brackets may be mounted on one side of the cradle. The shock absorbers have hinges, allowing the shock absorbers to be rotated to support different weapons. The swing bracket permits the weapon mount to be rotated 360° clockwise or counterclockwise, and the mount may be elevated 60° or lowered 10°. The cradle may be made of stainless steel.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

A fixed weapon mount is used to secure a weapon. In some instances, a fixed weapon mount is placed in an area that could be used for differing situations. In these cases, the mount must be frequently switched according to the situation. This may become cumbersome and tedious, and even life threatening when a quick switch in weaponry is necessary. There is a need for a weapon mount that is versatile, easy to use, can absorb forces generated by recoil, is lightweight and can be used for different types of weapons.

Figure 1:
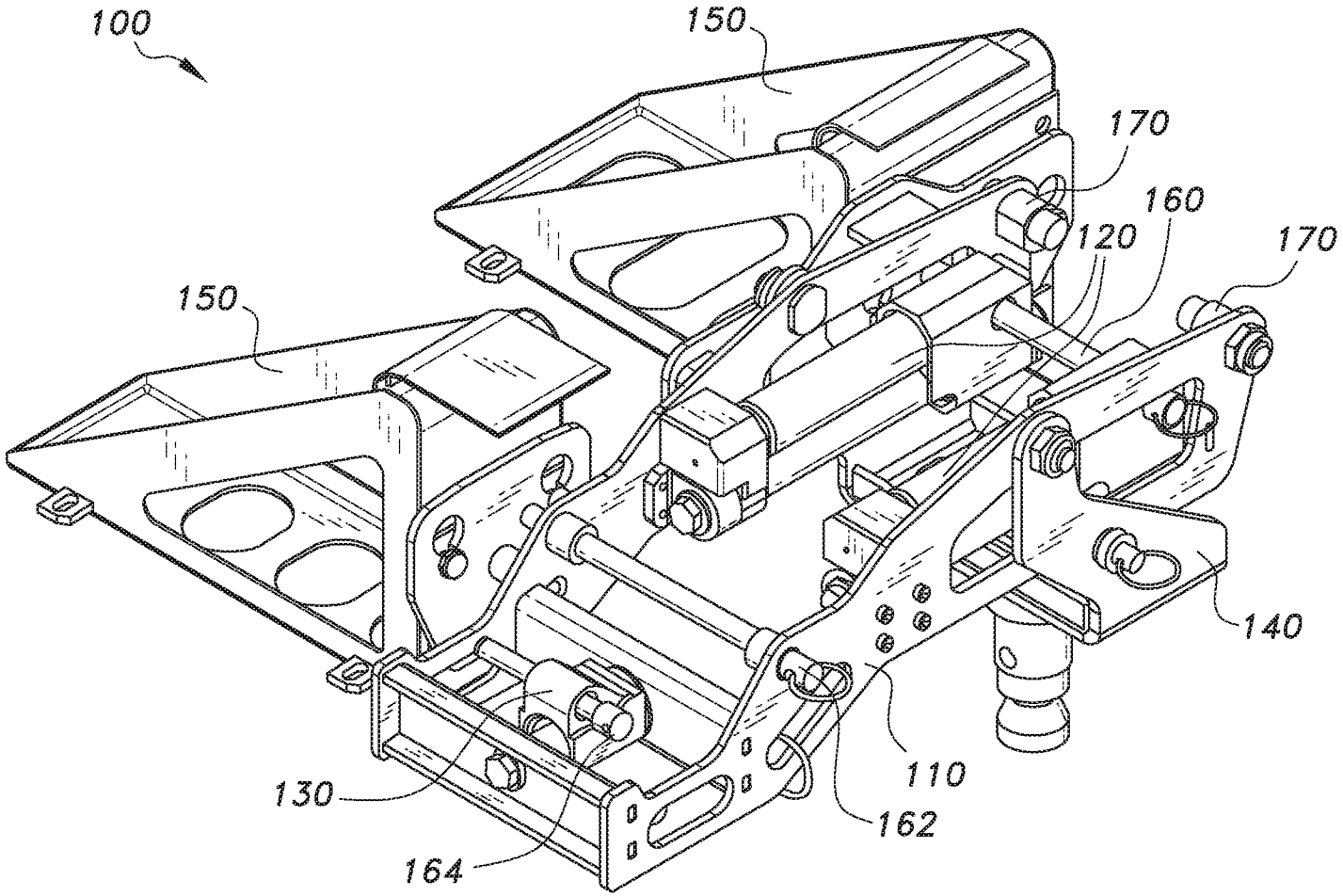
FIG. 1 is a perspective view of an exemplary weapon mount as described herein.

As shown in FIG. 1, the weapon mount 100 includes a cradle 110 and a pair of shock absorbers 120 located within the cradle 110. The cradle 110 is an elongated, generally rectangular frame having a pair of elongated side plates, a short front plate extending between the front ends of the side plates, and a rear plate extending between the rear ends of the side plates. The side plates have an elongated front portion, an intermediate section sloping downward at about a 45° angle from the front portion, and a short rear portion extending rearward from the intermediate portion. A short intermediate plate extends between the side plates between the intermediate portion and the rear portion. A shaft or pin extends between the intermediate plate and the rear plate. The side plates have a plurality of slots and apertures defined therein for mounting fixed support pins and inserting removable connection pins through the cradle, as described below.

The shock absorbers 120 are parallel to each other and extend longitudinally in the cradle 110 on opposite sides of the cradle 110 in the raised front portion of the cradle 110, the shock absorbers 120 having a hinge attached to the side plates of the cradle 110. In some embodiments, the front end of the shock absorbers 120 may be pivoted downward on the hinge toward the open center of the cradle 110.

A back sliding support 130 is slidably mounted in the rear portion of the cradle 110 on the shaft extending between the intermediate plate and the rear plate, and has a boss for receiving a removable connection pin 164 that provides support for attaching some weapons to the cradle 110. The cradle 110 may be attached to a swing bracket 140, which allows rotation of 360° transversely in the left and right directions and pivoting vertically at least 60° upward to elevate the weapon or downward at least 10° to lower the weapon. Dual ammo can boxes 150 or a single ammo can box 152 (shown in FIG. 3) can be attached to the sides of the cradle 110. This provides storage of ammunition in a convenient, safe location.

Removable connection pins are used to selectively secure a weapon to the cradle 110. Depending on the size and shape of the weapon to be mounted, the connection pins provided on the cradle 110 can be used to secure a weapon to the weapon mount 100. FIG. 1 shows a front connection pin 160, a middle connection pin 162 and a rear connection pin 164. The front connection pin 160 passes through the shock absorbers 120 at a front portion of the cradle 110. The middle connection pin 162 passes through a middle portion of the cradle 110, and the rear connection pin 164 passes through the back sliding support 130 at the rear portion of the cradle 110. A front fixed support 170 is also provided to secure a weapon to the weapon mount 100.

Figure 2A:
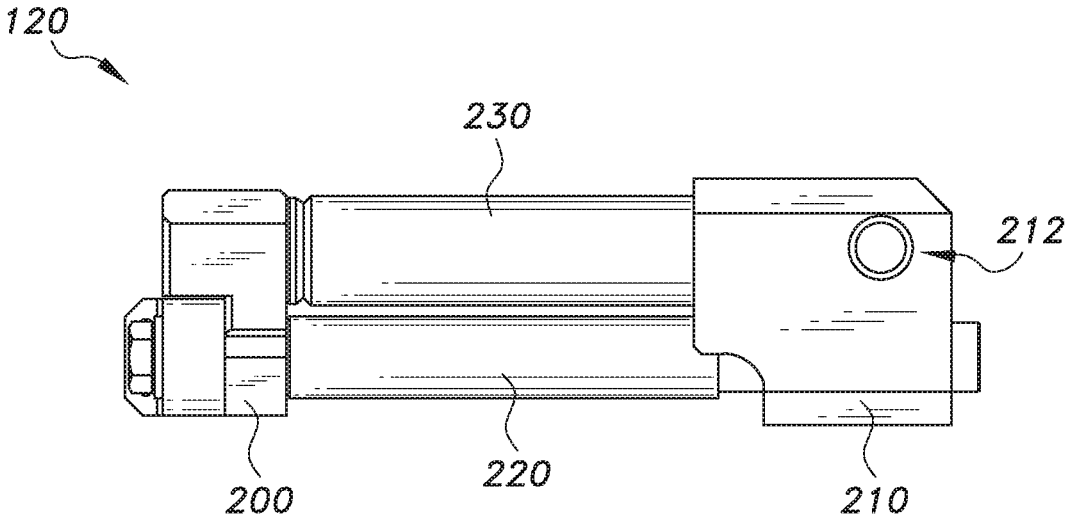
FIG. 2A is a side view of a shock absorber of the weapon mount of FIG. 1.
Figure 2B:
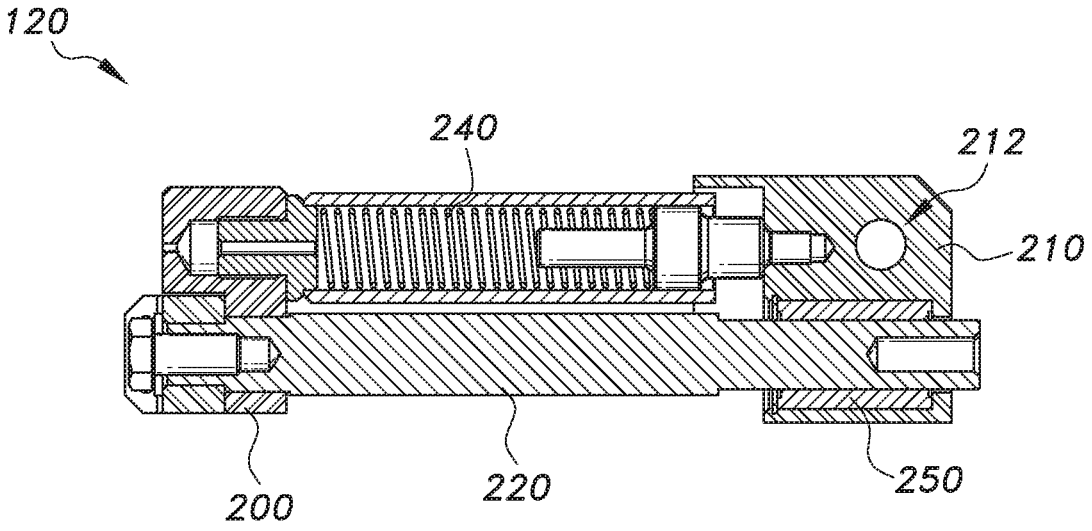
FIG. 2B is a side view in section of the shock absorber of FIG. 2A.

As shown in FIGS. 2A and 2B, each of the shock absorbers 120 includes a hinge 200, a slider 210, and a sliding shaft 220 extending from the hinge 200 and passing through the slider 210. The slider 210 has a pin connection hole 212 through which the front connection pin 160 passes. A cover 230 extends from the hinge 200 to the slider 210. A coil spring 240 is housed within the cover 230. A bearing 250 is located within the slider 210, allowing for easy movement of the sliding shaft 200.

Each of the shock absorbers 120 has the same construction and provides smooth movement and good repeatability of sliding. The hinge 200 allows for rotation of the shock absorbers 120 so that the shock absorbers 120 may be turned down to accommodate different weapons.

It is understood that the foregoing description of the shock absorber 120 shows one type of shock absorber that can be used. Other types of shock absorbers may be used depending on the situation. The shock absorbers 120 help to absorb recoil when the weapon is fired, improving accuracy and reducing strain on the operator of the weapon.

The weapon mount 100 described above can mount a variety of different weapons. The following description discloses how three different types of weapons may be mounted to weapon mount 100.

Figures 3, 3A, 3B:
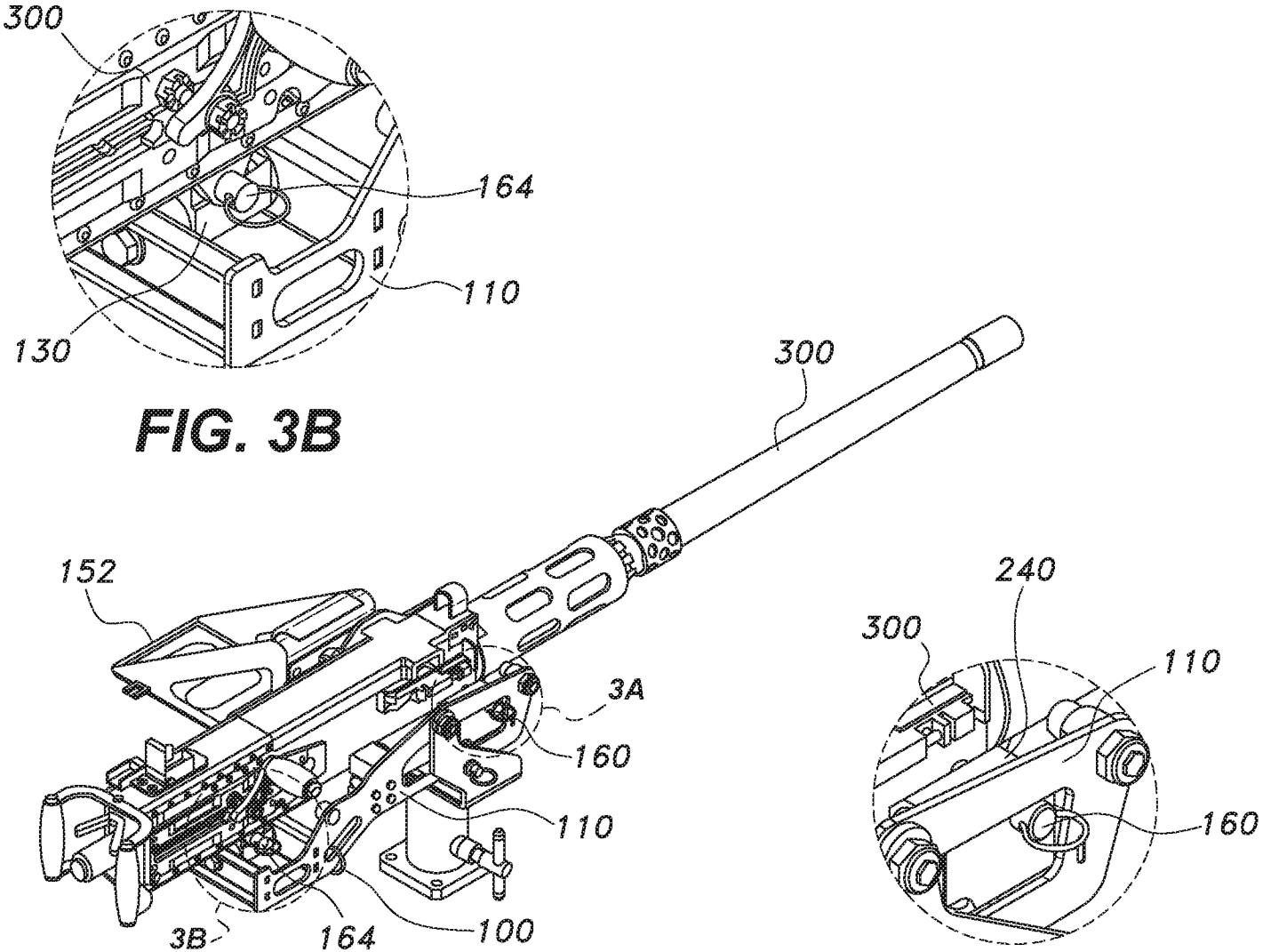
FIG. 3 is an environmental perspective view of a .50 caliber weapon mounted to the weapon mount.
FIG. 3A is a detail view of area 3A of FIG. 3, showing details of a connection pin attaching the .50 caliber weapon to the shock absorbers.
FIG. 3B is a detail view of area 3B of FIG. 3, showing details of a connection pin attaching the .50 caliber weapon to the rear sliding support.

FIG. 3 is shows a .50 caliber machine gun 300 attached to the weapon mount 100. FIG. 3A is a detail view of area 3A at the front of the cradle 110, and FIG. 3B is a detail view of area 3B near the rear of the cradle 110.

The weapon 300 is secured to a front portion of the shock absorbers 120 with front connection pin 160. FIG. 3A shows the front connection pin 160 inserted through a slot in the cradle 110 and then through the holes 212 in the sliders 210 of the two shock absorbers 120 and through the weapon 300, thereby securing the weapon 300 to the front of the cradle 110. The weapon 300 is secured to the rear portion of the cradle 110 with rear connection pin 164. FIG. 3B shows the rear connection pin 164 attaches the rear of the weapon 300 to the back sliding support 130, thereby securing the weapon 300 to the rear portion of the cradle 110.

The foregoing description may apply to a .50 caliber weapon, and as discussed, it is mounted through front and rear connection pins 160,164 to the shock absorbers 240 and the back sliding support 130, respectively. In FIG. 3, a single ammo can box 152 is attached to the front portion of the cradle 110.

Figure 4A:
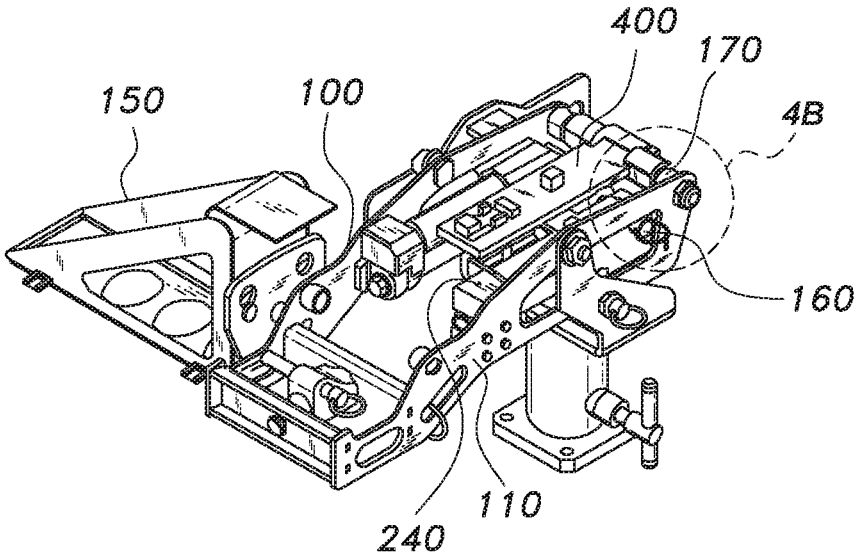
FIG. 4A is a perspective view of the weapon mount of FIG. 1, shown with an adapter for mounting a 7.62 mm weapon on the weapon mount.
Figure 4B:
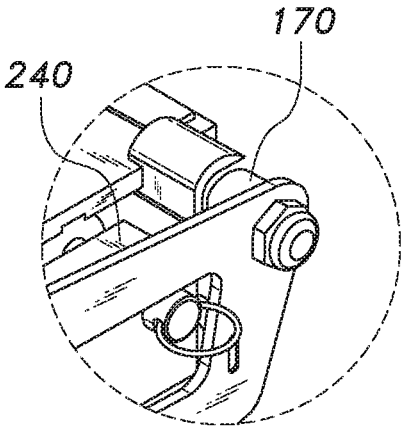
FIG. 4B is a detail view of area 4B of FIG. 4A, showing details thereof.

FIG. 4A shows the weapon mount 100 equipped with an adapter plate 400 for mounting a 7.62 mm machine gun. The adapter plate 400 is attached to the front of the cradle 110 by a front fixed support 170, as shown in FIG. 4B, and to shock absorbers 120 via the front connection pin 160. An example of a weapon that can be connected in this manner is a 7.62 caliber machine gun. This weapon can be connected to the weapon mount 100 using the adapter plate 400. The 7.62 mm machine gun is attachable to the adapter plate, and the adapter plate 400 is connected to the weapon mount 100 via the front fixed support 170 and the shock absorbers 120 via front connection pin 160. An ammo can box 150, as illustrated, is connected to a rear portion of the cradle 100.

Figures 5, 5A, 5B:
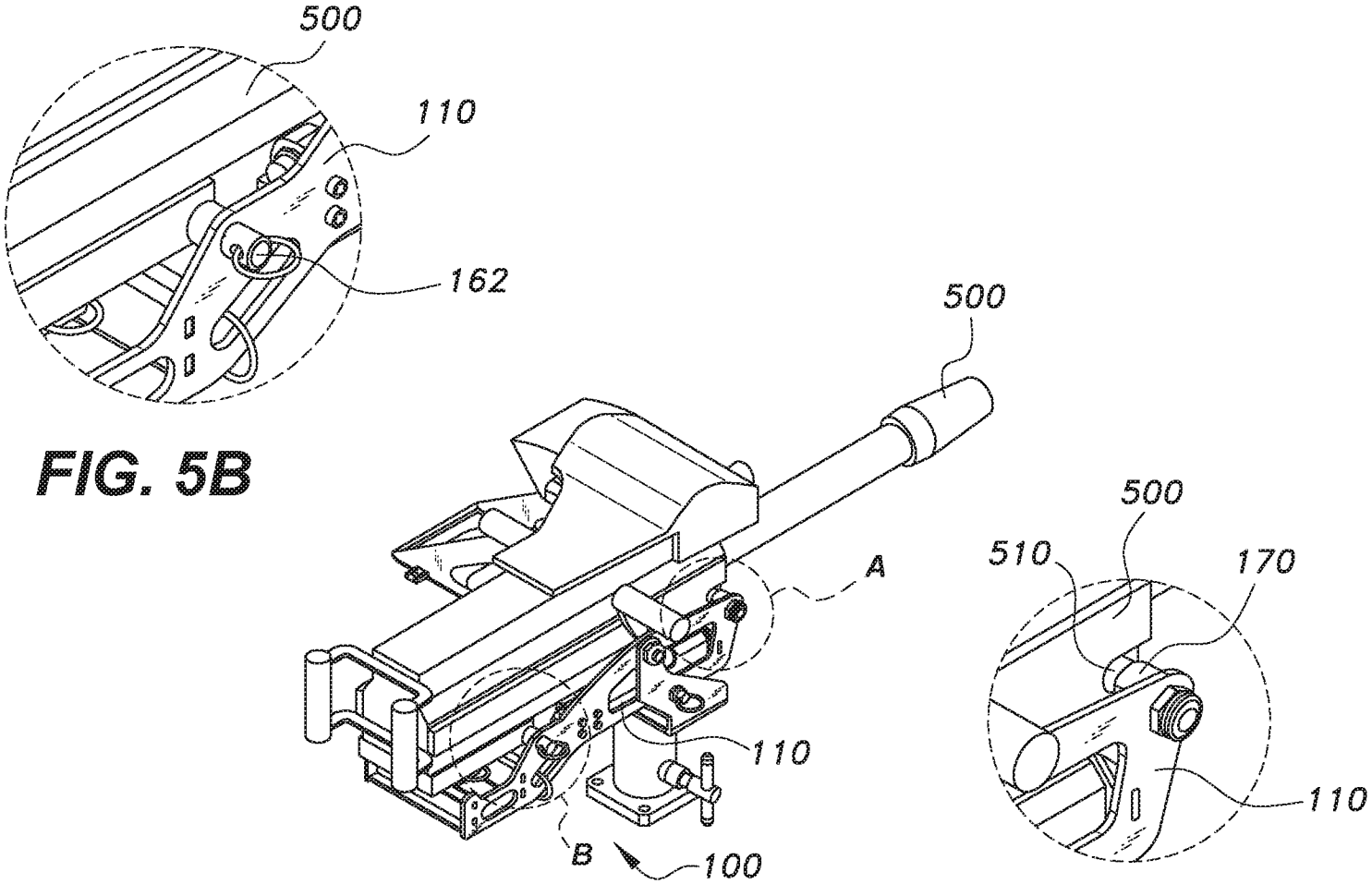
FIG. 5 is a perspective view of a .40 caliber weapon mounted on the weapon mount of FIG. 1.
FIG. 5A is a detail view of area 5A of FIG. 5, showing details thereof.
FIG. 5B is a detail view of area 5B of FIG. 5, showing details thereof.

FIG. 5 shows a .40 caliber machine gun 500 mounted on the weapon mount 100. Weapon 500 is mounted to cradle 110 of fixed weapon mount 100. FIG. 5A shows how the weapon 500 engages the front fixed support 170 of the cradle 110. There is a notch 510 on the weapon 500 that slides onto the front fixed support 170. This securely engages weapon 500 to the front portion of cradle 110. FIG. 5B shows how the weapon 500 is connected to the intermediate portion of cradle 110 via the middle connection pin 162. The middle connection pin 162 goes through the sides of the cradle 110 and through the weapon 500, thereby fixing the weapon 500 to the cradle 110. It is noted that in this example the weapon 500 is not connected to the shock absorbers 120. In some embodiments, the shock absorbers 120 may be turned down, providing additional room for the weapon to be mounted.

In this example, a .40 caliber machine gun 500 can be mounted as described in relation to FIGS. 5, 5A and 5B. The weapon would be secured to the cradle 110 through the front fixed support 170 and the middle connection pin 162. The weapon is not connected to the shock absorbers 120 and has a fixed position on the weapon mount 100.

Figure 6B:
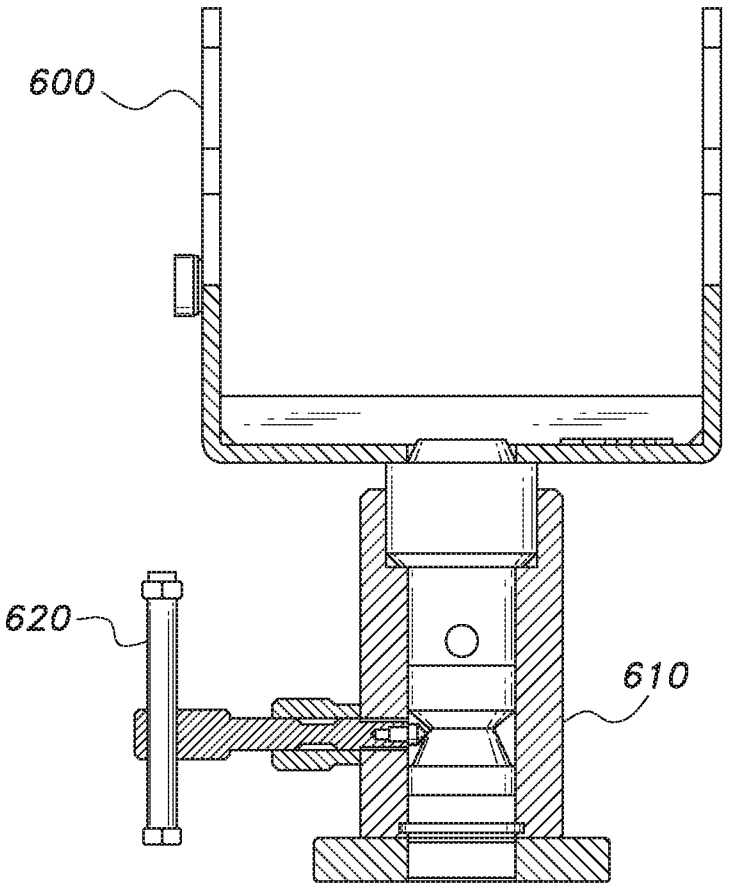
FIG. 6B is a section view drawn along lines 6B-6B of FIG. 6A.
Figure 6A:
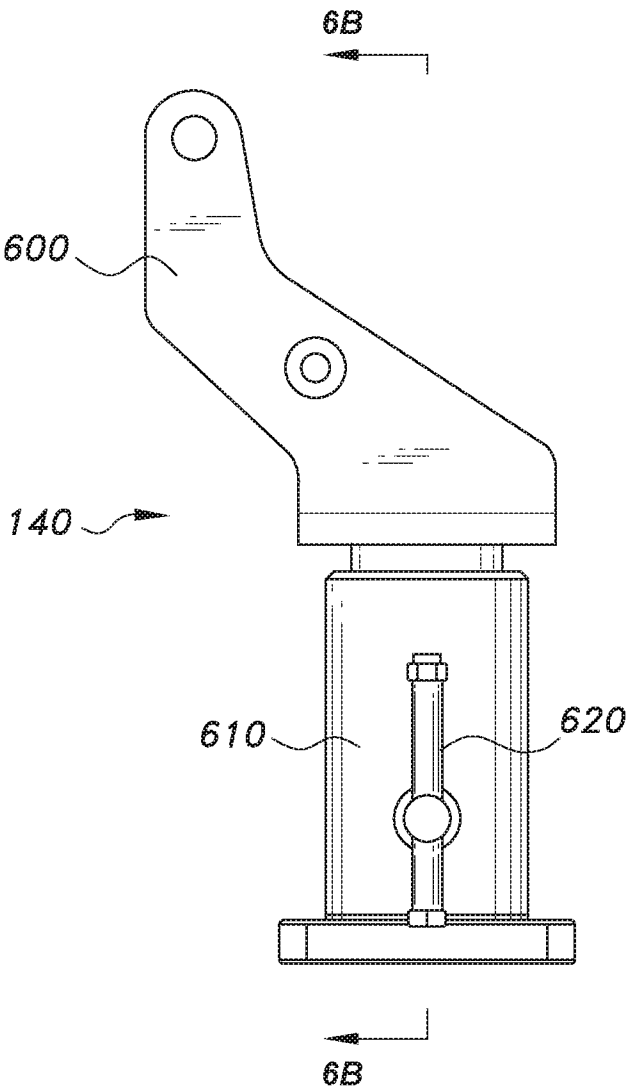
FIG. 6A is a side view of the swing bracket of the weapon mount of FIG. 1.

As shown in FIGS. 6A and 6B, the cradle 110 may be attached to a swing bracket 140 that permits the weapon to rotate transversely 360°, either clockwise or counterclockwise, and to be elevated up to 60° or to be depressed or lowered 10°. The swing bracket 140 includes an upper U-shaped swing bracket 600 that receives the cradle 110 and a pintle that rotates or pivots in a socket formed in a mounting base 610.

As shown in FIG. 6B, the pintle depending from the U-shaped swing bracket has an annular notch defined therein. The pintle is secured in the socket of the mounting base by a retainer pin that has a roller bearing at its tip end engaging the notch in the pintle, thereby permitting rotation of the swing bracket 600 while retaining the pintle in the mounting base 610.

Embodiments of the weapon mount 100 described herein accept the mounting of the Browning M2 machine gun series, as well as .40 caliber machine guns or grenade launchers and 7.62 mm machine guns using a MG3 adapter. The weapon mount is designed to make production easier and more economical, while obtaining better quality and performance of the cradle itself.

The shape of the cradle, reinforced swing bracket as well as the construction of the shock absorbers provide better alignment and reliability in mounting the weapon as well as better recoil withstanding forces.

The cradle is made lighter by reducing the thickness of the raw material used. In some embodiments the cradle is made of aluminum or an aluminum alloy. Strength calculations were performed, which showed better reliability of the cradle. A special welding fixture was designed and produced to make assembling of the cradle simple, thereby increasing the quality without the necessity of welding after machining operations.

The cradle was designed to be easy for production and assembling. Front and back support plates were designed to strengthen the cradle, and also to provide better alignment of the shock absorbers. A high technical level is not required for assembly, as all parts can be easily placed in the right position through the special pins.

The shock absorbers are redesigned to better withstand recoil forces and give more accuracy to the gun alignment. The number of machined parts in the shock absorber assemblies was also reduced.

It is to be understood that the weapon mount is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A weapon mount, comprising:

a cradle having raised front portion, a lower rear portion, and an intermediate portion sloping downward between the front portion and the rear portion, the cradle defining an open frame and having a front support;

a back sliding support selectively slidable forward and rearward in the rear portion of the cradle;

a first removable connection pin selectively extending across the frame in the front portion of the cradle;

a second removable connection pin selectively extending across the frame in the intermediate portion of the cradle;

a third removable connection pin selectively passing through the back sliding support; and a first shock absorber and a second shock absorber extending parallel to each other on opposite sides of the front portion of the cradle, each of the shock absorbers including: a main body and a hinge attached to the main body and the cradle, the hinge having a pivot axis extending parallel to each of the shock absorbers and allowing for each of the first shock absorber and the second shock absorber to be turned down relative to the cradle, the first removable connection pin extending through the cradle and through the first and second shock absorbers.

2. The weapon mount of claim 1, further comprising a swing bracket having:

a U-shaped body and a pintle depending from the U-shaped body, the cradle being mounted on the U-shaped body; and a mounting base defining a socket, the pintle being inserted in the socket and rotatable therein, the swing bracket permitting rotation of the cradle 360° clockwise and counterclockwise transversely and pivoting elevation of the cradle 60° upward and 10° downward.

3. The weapon mount of claim 1, further comprising at least one ammo can box attached to a side portion of the cradle.

4. The weapon mount according to claim 1, further comprising an adapter plate for mounting a 7.62 mm machine gun to said cradle, the adapter plate being mounted on the front support of the cradle and by insertion of the first connection pin through said cradle, the adapter plate, and the first and second shock absorbers.

5. The weapon mount according to claim 1, wherein the weapon mount is adapted for mounting a .50 caliber machine gun to said cradle by insertion of the first connection pin through the machine gun and through the front portion of said cradle and by insertion of the third connection pin through the machine gun and through the sliding back support.

6. The weapon mount according to claim 1, wherein the weapon mount is adapted for mounting a .40 caliber weapon to said cradle by engaging the weapon against the front support and by insertion of the second connection pin through the weapon and through the intermediate portion of said cradle.

7. A weapon mount, comprising:

a cradle having raised front portion, a lower rear portion, and an intermediate portion sloping downward between the front portion and the rear portion, the cradle defining an open frame and having a front support;

a back sliding support selectively slidable forward and rearward in the rear portion of the cradle;

a first removable connection pin selectively extending across the frame in the front portion of the cradle;

a second removable connection pin selectively extending across the frame in the intermediate portion of the cradle;

a third removable connection pin selectively passing through the back sliding support;

a first shock absorber and a second shock absorber extending parallel to each other on opposite sides of the front portion of the cradle, each of the shock absorbers including: a main body and a hinge attached to the main body and the cradle, the hinge having a pivot axis extending parallel to each of the shock absorbers and allowing for each of the first shock absorber and the second shock absorber to be turned down relative to the cradle, the first removable connection pin extending through the cradle and through the first and second shock absorbers; and a swing bracket connected to a bottom portion of the cradle, the swing bracket being rotatable in the left and right direction, and the up and down direction.

8. The weapon mount of claim 7, wherein the swing bracket further comprises:

a U-shaped body and a pintle depending from the U-shaped body, the cradle being mounted on the U-shaped body; and a mounting base defining a socket, the pintle being inserted in the socket and rotatable therein, the swing bracket permitting rotation of the cradle 360° clockwise and counterclockwise transversely and pivoting elevation of the cradle 60° upward and 10° downward.

9. The weapon mount of claim 7, further comprising at least one ammo can box attached to a side portion of the cradle.

10. The weapon mount according to claim 7, further comprising an adapter plate for mounting a 7.62 mm machine gun to said cradle, the adapter plate being mounted on the front support of the cradle and by insertion of the first connection pin through said cradle, the adapter plate, and the first and second shock absorbers.

11. The weapon mount according to claim 7, wherein the weapon mount is adapted for mounting a .50 caliber machine gun to said cradle by insertion of the first connection pin through the machine gun and through the front portion of said cradle and by insertion of the third connection pin through the machine gun and through the sliding back support.

12. The weapon mount according to claim 7, wherein the weapon mount is adapted for mounting a .40 caliber weapon to said cradle by engaging the weapon against the front support and by insertion of the second connection pin through the weapon and through the intermediate portion of said cradle.

* * * * *